US010380946B2

(12) United States Patent
Liu et al.

(10) Patent No.: US 10,380,946 B2
(45) Date of Patent: Aug. 13, 2019

(54) OLED PIXEL CIRCUITRY, DRIVING METHOD THEREOF AND DISPLAY DEVICE

(71) Applicant: BOE TECHNOLOGY GROUP CO., LTD., Beijing (CN)

(72) Inventors: Dongni Liu, Beijing (CN); Shengji Yang, Beijing (CN); Xiaochuan Chen, Beijing (CN); Zheng Fang, Beijing (CN); Han Yue, Beijing (CN); Jie Fu, Beijing (CN); Li Xiao, Beijing (CN); Lei Wang, Beijing (CN); Pengcheng Lu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/580,028

(22) PCT Filed: Jun. 21, 2017

(86) PCT No.: PCT/CN2017/089357

§ 371 (c)(1),
(2) Date: Dec. 6, 2017

(87) PCT Pub. No.: WO2018/113221

PCT Pub. Date: Jun. 28, 2018

(65) Prior Publication Data

US 2018/0301094 A1 Oct. 18, 2018

(30) Foreign Application Priority Data

Dec. 20, 2016 (CN) ..... 2016 1 1184958

(51) Int. Cl.

| | |
|---|---|
| ***G09G 3/3258*** | (2016.01) |
| ***G09G 3/3266*** | (2016.01) |
| ***G09G 3/3233*** | (2016.01) |

(52) U.S. Cl.
CPC ..... *G09G 3/3258* (2013.01); *G09G 3/3233* (2013.01); *G09G 3/3266* (2013.01);
(Continued)

(58) Field of Classification Search
CPC ..... G09G 3/3258; G09G 3/3266
See application file for complete search history.

(56) References Cited

U.S. PATENT DOCUMENTS

| | | | |
|---|---|---|---|
| 5,132,820 | A | 7/1992 | Someya et al. |
| 8,665,187 | B2 | 3/2014 | Kishi |

(Continued)

FOREIGN PATENT DOCUMENTS

| | | |
|---|---|---|
| CN | 1525645 | 9/2004 |
| CN | 1543637 | 11/2004 |

(Continued)

OTHER PUBLICATIONS

Search Report for International Patent Application No. PCT/CN2017/089357 dated Sep. 21, 2017.

(Continued)

*Primary Examiner* — Carolyn R Edwards
(74) *Attorney, Agent, or Firm* — Calfee, Halter & Griswold LLP

(57) ABSTRACT

The present disclosure relates to an OLED pixel circuitry, a driving method thereof and a display device. The OLED pixel circuitry includes: a driving circuit, a light emitting circuit and a short-circuit protection circuit, wherein the driving circuit is coupled to a scan signal input terminal, a data signal input terminal, a first voltage terminal and the light emitting circuit respectively, and is configured to drive the light emitting circuit to emit light; the light emitting circuit is further coupled to a second voltage terminal, and is configured to emit light; and the short-circuit protection circuit is coupled to the driving circuit and the light emitting (Continued)

circuit, and is configured to control the driving circuit to be turned off when a short circuit occurs in the light emitting circuit.

18 Claims, 5 Drawing Sheets

(52) U.S. Cl.
CPC ..... *G09G 2300/0809* (2013.01); *G09G 2300/0852* (2013.01); *G09G 2330/08* (2013.01)

(56) References Cited

U.S. PATENT DOCUMENTS

| | | | | |
|---|---|---|---|---|
| 9,088,010 | B2 | 7/2015 | Kamada | |
| 9,189,990 | B2 | 11/2015 | Park et al. | |
| 9,713,224 | B2 | 7/2017 | Hente | |
| 2003/0142509 | A1* | 7/2003 | Tsuchiya | G09G 3/3266 362/555 |
| 2005/0134189 | A1* | 6/2005 | Osame | G09G 3/3266 315/169.1 |
| 2005/0162354 | A1* | 7/2005 | Osame | G09G 3/3233 345/76 |
| 2006/0022900 | A1* | 2/2006 | Miyake | G09G 3/3233 345/55 |
| 2008/0225061 | A1* | 9/2008 | Kimura | G09G 3/3233 345/690 |
| 2009/0243979 | A1* | 10/2009 | Kim | G09G 3/3233 345/76 |
| 2010/0182352 | A1* | 7/2010 | Nakamura | G09G 3/3233 345/691 |
| 2011/0164071 | A1* | 7/2011 | Chung | G09G 3/3208 345/690 |
| 2012/0162176 | A1* | 6/2012 | Kim | G09G 3/3258 345/211 |
| 2012/0248471 | A1 | 10/2012 | Kishi | |
| 2012/0306373 | A1 | 12/2012 | Kamada | |
| 2014/0124754 | A1 | 5/2014 | Park et al. | |
| 2014/0292625 | A1* | 10/2014 | Lee | G09G 3/3233 345/82 |
| 2015/0084030 | A1 | 3/2015 | Minami et al. | |
| 2016/0300900 | A1* | 10/2016 | Miyake | G09G 3/3233 |
| 2016/0353546 | A1 | 12/2016 | Hente | |
| 2017/0018229 | A1 | 1/2017 | Zhang et al. | |
| 2017/0294166 | A1* | 10/2017 | Kim | G09G 3/3266 |
| 2017/0301290 | A1* | 10/2017 | Qing | G09G 3/3233 |
| 2017/0309209 | A1* | 10/2017 | Kenmotsu | G09G 3/3233 |
| 2018/0254008 | A1* | 9/2018 | Toyomura | G09G 3/3233 |

FOREIGN PATENT DOCUMENTS

| | | | |
|---|---|---|---|
| CN | 201035270 | | 3/2008 |
| CN | 101202014 | | 6/2008 |
| CN | 101231412 | | 7/2008 |
| CN | 101276528 | A | 10/2008 |
| CN | 102771190 | A | 11/2012 |
| CN | 104933993 | A | 9/2015 |
| CN | 105981475 | A | 9/2016 |
| CN | 106448564 | A | 2/2017 |
| CN | 206271397 | U | 6/2017 |
| EP | 2536257 | B1 | 2/2011 |
| EP | 2536257 | A1 | 12/2012 |
| EP | 3100062 | | 12/2016 |
| WO | 2015113805 | A1 | 8/2015 |

OTHER PUBLICATIONS

Office action from Chinese Application No. 20161184958.6 dated May 25, 2018.

* cited by examiner

OLED PIXEL CIRCUITRY, DRIVING METHOD THEREOF AND DISPLAY DEVICE

CROSS REFERENCE

The present application is based upon International Application No. PCT/CN2017/089357, filed on Jun. 21, 2017, which is based upon and claims priority to Chinese Patent Application No. 201611184958.6, filed on Dec. 20, 2016, and the entire contents thereof are incorporated herein by reference.

TECHNICAL FIELD

The present disclosure relates to the field of display technology, and more particularly, to an OLED pixel circuitry, a driving method thereof and a display device.

BACKGROUND

With the rapid development of multimedia technology, an OLED (Organic Light-Emitting Diode) has become an important light emitting element in the display device due to its advantages of self-luminous, high contrast, wide color range, simple preparation process, low power consumption, liable to achieving flexible, or the like.

Among the OLEDs, an AM-OLED (Active Matrix/Organic Light Emitting Diode) display panel has become the research hotspot because of advantages such as no viewing angle limitation, low manufacturing cost, high response speed, low power consumption, wide operating temperature range, light weight, applicable to DC drive of portable devices, and capable of being minimized and slimming along with hardware devices and so on.

It should be noted that, information disclosed in the above background portion is provided only for better understanding of the background of the present disclosure, and thus it may contain information that does not form the prior art known by those ordinary skilled in the art.

SUMMARY

The embodiments of the present disclosure provide an OLED pixel circuitry, a driving method thereof and a display device.

The embodiments of the present disclosure adopt the following technical solutions.

According to a first aspect, there is provided an OLED pixel circuitry, including a driving circuit, a light emitting circuit and a short-circuit protection circuit, wherein the driving circuit is coupled to a scan signal input terminal, a data signal input terminal, a first voltage terminal and the light emitting circuit respectively, and is configured to drive the light emitting circuit to emit light under control of the scan signal input terminal, the data signal input terminal and the first voltage terminal; the light emitting circuit is further coupled to a second voltage terminal, and is configured to emit light under control of the driving circuit and the second voltage terminal; and the short-circuit protection circuit is coupled to the driving circuit and the light emitting circuit, and is configured to control the driving circuit to be turned off when a short circuit occurs in the light emitting circuit.

Optionally, the driving circuit includes a first transistor, a first capacitor and a second transistor; a gate electrode of the first transistor is connected to the scan signal input terminal, a first electrode of the first transistor is coupled to the data signal input terminal, and a second electrode of the first transistor is coupled to a gate electrode of the second transistor; a first electrode of the second transistor is coupled to the first voltage terminal, and a second electrode of the second transistor is coupled to the light emitting circuit; a first terminal of the first capacitor is coupled to the second electrode of the first transistor, and a second terminal of the first capacitor is coupled to the first electrode of the second transistor; and the second transistor is an N-type transistor.

Optionally, the driving circuit includes a first transistor, a first capacitor and a second transistor; a gate electrode of the first transistor is coupled to the scan signal input terminal, a first electrode of the first transistor is coupled to the data signal input terminal, and a second electrode of the first transistor is coupled to a gate electrode of the second transistor; a first electrode of the second transistor is coupled to the first voltage terminal, and a second electrode of the second transistor is coupled to the light emitting circuit; a first terminal of the first capacitor is coupled to the second electrode of the first transistor, and a second terminal of the first capacitor is coupled to a second electrode of the second transistor; and the second transistor is an N-type transistor.

Optionally, the light emitting circuit includes an OLED, an anode of the OLED is coupled to the driving circuit, and a cathode of the OLED is coupled to the second voltage terminal.

Optionally, the short-circuit protection circuit includes a third transistor and a second capacitor; each of a gate electrode of the third transistor and a first electrode of the third transistor is coupled to both the light emitting circuit and the driving circuit, and a second electrode of the third transistor is coupled to a first terminal of the second capacitor; a second terminal of the second capacitor is coupled to the driving circuit; and the third transistor is a P-type transistor.

Further optionally, the driving circuit includes a first transistor, a first capacitor and a second transistor, and the light emitting circuit includes an OLED; the gate electrode of the third transistor is coupled to both a second electrode of the second transistor and an anode of the OLED, and the first electrode of the third transistor is coupled to both the second electrode of the second transistor and the anode of the OLED; and the second terminal of the second capacitor is coupled to both a second electrode of the first transistor and a gate electrode of the second transistor.

Optionally, a gate electrode of the first transistor is coupled to the scan signal input terminal, a first electrode of the first transistor is coupled to the data signal input terminal, and the second electrode of the first transistor is coupled to the gate electrode of the second transistor; a first electrode of the second transistor is coupled to the first voltage terminal, and the second electrode of the second transistor is coupled to the light emitting circuit; and a first terminal of the first capacitor is coupled to the second electrode of the first transistor, and a second terminal of the first capacitor is coupled to the first electrode of the second transistor.

Optionally, a gate electrode of the first transistor is coupled to the scan signal input terminal, a first electrode of the first transistor is coupled to the data signal input terminal, and the second electrode of the first transistor is coupled to the gate electrode of the second transistor; a first electrode of the second transistor is coupled to the first voltage terminal, and the second electrode of the second transistor is coupled to the light emitting circuit; and a first terminal of the first capacitor is coupled to the second electrode of the first transistor, and a second terminal of the first capacitor is coupled to the second electrode of the second transistor.

Optionally, the short-circuit protection circuit includes a fourth transistor and a second capacitor; a gate electrode of the fourth transistor is coupled to both the light emitting circuit and the driving circuit, a first electrode of the fourth transistor is coupled to both the light emitting circuit and the second voltage terminal, a second electrode of the fourth transistor is coupled to a first terminal of the second capacitor; a second terminal of the second capacitor is coupled to the driving circuit; and the fourth transistor is a P-type transistor.

Optionally, a gate electrode of the first transistor is coupled to the scan signal input terminal, a first electrode of the first transistor is coupled to the data signal input terminal, and a second electrode of the first transistor is coupled to a gate electrode of the second transistor; a first electrode of the second transistor is coupled to the first voltage terminal, and a second electrode of the second transistor is coupled to the light emitting circuit; a first terminal of the first capacitor is coupled to the second electrode of the first transistor, and a second terminal of the first capacitor is coupled to the first electrode of the second transistor.

Optionally, a gate electrode of the first transistor is coupled to the scan signal input terminal, a first electrode of the first transistor is coupled to the data signal input terminal, and a second electrode of the first transistor is coupled to a gate electrode of the second transistor; a first electrode of the second transistor is coupled to the first voltage terminal, and a second electrode of the second transistor is coupled to the light emitting circuit; a first terminal of the first capacitor is coupled to the second electrode of the first transistor, and a second terminal of the first capacitor is coupled to a second electrode of the second transistor.

Further optionally, the driving circuit includes a first transistor, a first capacitor and a second transistor; the light emitting circuit includes an OLED, and the gate electrode of the fourth transistor is coupled to both a second electrode of the second transistor and an anode of the OLED, and a first electrode of the fourth transistor is coupled to both a cathode of the OLED and the second voltage terminal; and the second terminal of the second capacitor is coupled to both the second electrode of the first transistor and a gate electrode of the second transistor.

Optionally, the first transistor is an N-type transistor.

According to a second aspect, there is provided a display device, including the OLED pixel circuitry according to the first aspect.

According to a third aspect, there is provided a driving method of the OLED pixel circuitry according to the first aspect, including: the scan signal input terminal inputting a scanning signal, the data signal input terminal inputting a data signal, and the driving circuit driving the light emitting circuit to emit light; and in the case where a short circuit occurs in the light emitting circuit, the short-circuit protection circuit controlling the driving circuit to be turned off.

Optionally, the driving method includes: the scan signal input terminal inputting the scanning signal to control the first transistor to be turned on, and the data signal input terminal inputting the data signal to control the second transistor to be turned on, to drive the OLED to emit light; in the case where the OLED emits light normally, a signal output by the second transistor to the anode controlling the third transistor to be turned off; and in the case where the OLED is short-circuited, a signal applied to the anode by the second voltage terminal controlling the third transistor to be turned on, such that the second transistor is turned off.

Optionally, the driving method includes: the scan signal input terminal inputting the scanning signal to control the first transistor to be turned on, and the data signal input terminal inputting the data signal to control the second transistor to be turned on, to drive the OLED to emit light; in the case where the OLED emits light normally, a signal output by the second transistor to the anode controlling the fourth transistor to be turned off; and in the case where the OLED is short-circuited, a signal applied to the anode by second voltage terminal controlling the fourth transistor to be turned on, such that the second transistor is turned off.

It is to be understood that both the foregoing general description and the following detailed description are exemplary and explanatory only and are not restrictive of the disclosure, as claimed.

This section provides a summary of various implementations or examples of the technology described in the disclosure, and is not a comprehensive disclosure of the full scope or all features of the disclosed technology.

BRIEF DESCRIPTION OF THE DRAWINGS

In order to more clearly illustrate the technical solutions of the embodiments of the present disclosure, drawings of the embodiments of the present disclosure will be briefly described below. It will be apparent that the drawings in the following description refer only to some embodiments of the present disclosure, and other drawings are available to those of ordinal skill in the art based on these drawings without creative work.

REFERENCE NUMERALS

10—driving module; 20—light emitting module; 30—short-circuit protection module; GATE—scan signal input terminal; DATA—data signal input terminal; V1—first voltage terminal; V2—second voltage terminal; C1—first capacitor; C2—second capacitor; T1—first transistor; T2—second transistor; T3—third transistor.

DETAILED DESCRIPTION

The technical solutions of the embodiments of the present disclosure will be described clearly and completely in conjunction with the accompanying drawings of the embodiments of the present disclosure. It is obvious that the described embodiments are part of the embodiments rather than all embodiments of the present disclosure. All other embodiments obtained by one of ordinary skill in the art based on the described embodiments of the present disclosure without creative work are within the protection scope of the present disclosure.

In an OLED pixel circuit according to one embodiment of the present disclosure, each film layer between an anode and a cathode of the OLED is thin, and is further thinner due to foreign matter in the film or bad process control of forming holes or inclined plane. Accordingly, short circuit may occur due to the small resistance between the anode and the cathode of the OLED, thus affecting the voltage difference between the cathode and anode of the OLED in peripheral sub-pixels, and in turn, affecting the display of the peripheral sub-pixels.

Figure 1:
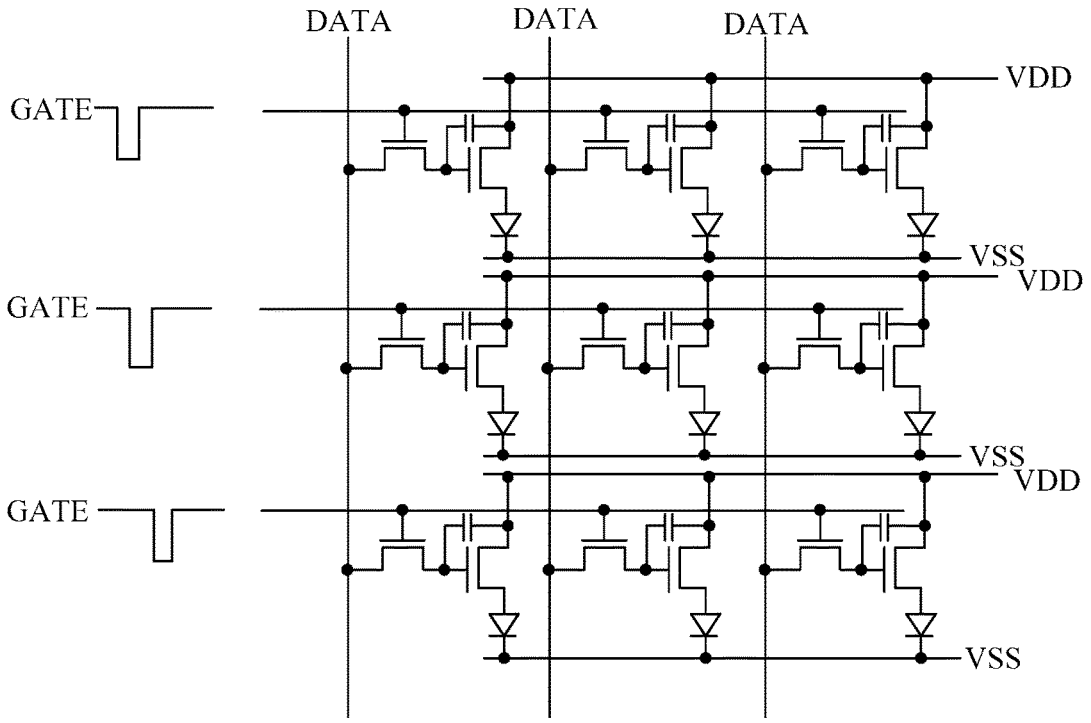
FIG. 1 is a schematic diagram of a structure of an OLED pixel circuit.

FIG. 1 is a schematic diagram of a structure of an OLED pixel circuit. As shown in FIG. 1, in a pixel structure of an AM-OLED display panel, each sub-pixel is integrated with a set of a transistor and a first capacitor. The control of a current of an OLED in a sub-pixel is achieved through driving control of the transistor and the first capacitor, thus driving the OLED to emit light.

Figure 2:
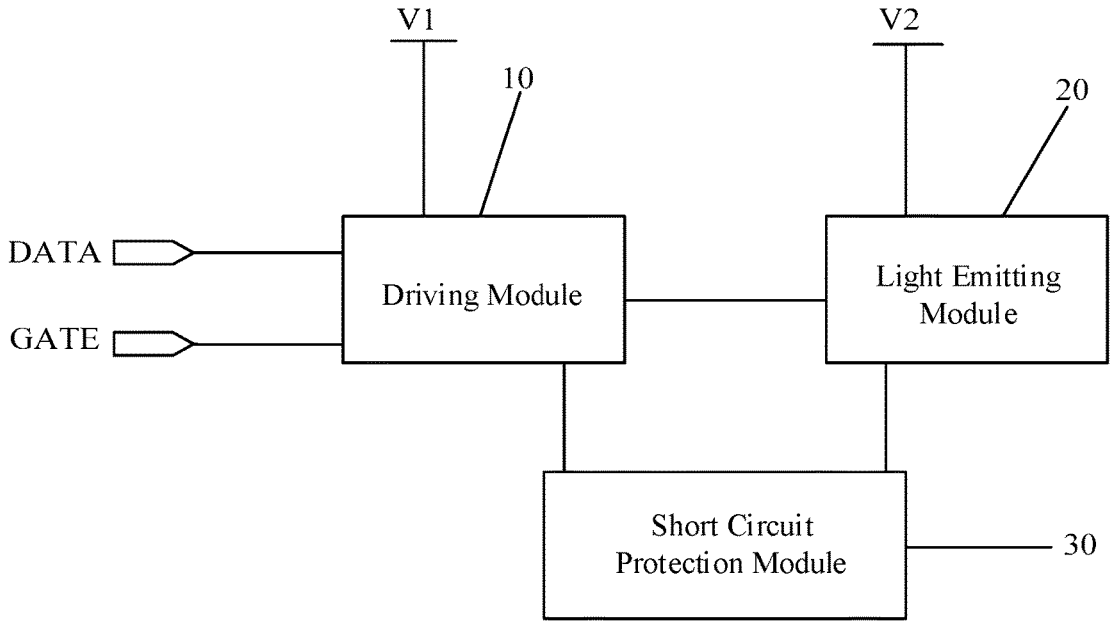
FIG. 2 is a schematic structural diagram of an OLED pixel circuit according to an embodiment of the present disclosure.

Another embodiment of the present disclosure provides an OLED pixel circuit. As shown in FIG. 2, the OLED pixel circuit includes a driving module 10, a light emitting module 20 and a short-circuit protection module 30.

The driving module 10 is connected to a scan signal input terminal GATE, a data signal input terminal DATA, a first voltage terminal V1 and the light emitting module 20 respectively, and is configured to drive the light emitting module 20 to emit light under control of the scan signal input terminal GATE, the data signal input terminal DATA and the first voltage terminal V1.

The light emitting module 20 is further connected to a second voltage terminal V2, and is configured to emit light under control of the driving module 10 and the second voltage terminal V2.

The short-circuit protection module 30 is connected to the driving module 10 and the light emitting module 20, and is configured to control the driving module 10 to be turned off when a short circuit occurs in the light emitting module 20.

The embodiments of the present disclosure provide an OLED pixel circuit. A short-circuit protection module 30 is added to the OLED pixel circuit. When a light emitting module 20 of a sub-pixel emits light normally, the short-circuit protection module 30 is turned off, while when the light emitting module 20 of the sub-pixel is short-circuited, the short-circuit protection module 30 is turned on to control to turn off the driving module 10, so that signals of the first voltage terminal V1 and the data single input terminal DATA cannot be output to the light emitting module 20. In this way, even if the light emitting module 20 is short-circuited, a signal at the second voltage terminal V2 connected to the light emitting module 20 will not rise, but still maintains its original signal intensity, so as to prevent a certain sub-pixel where a short circuit occurs from affecting the normal display of the peripheral sub-pixels.

The specific structure of each module in FIG. 2 will be described in detail below with reference to the specific embodiments.

Figure 3:
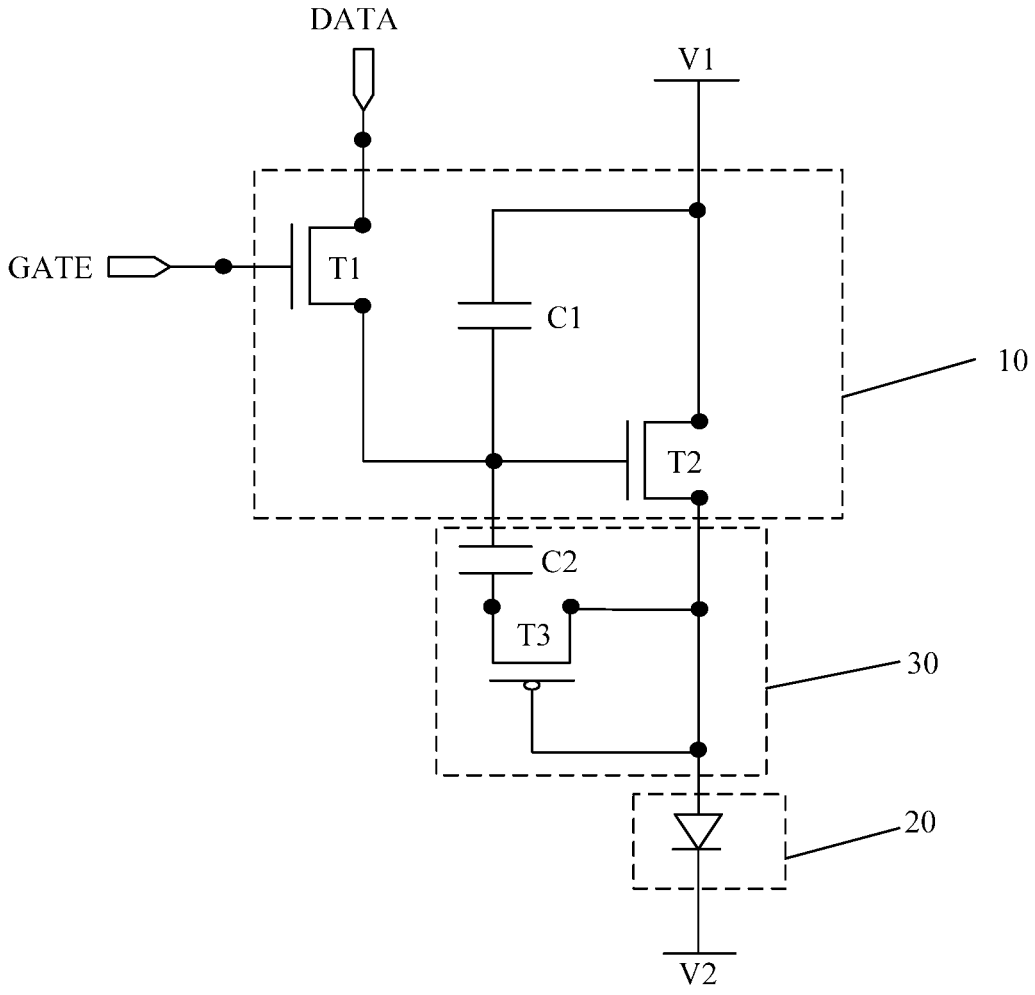
FIG. 3 is a first schematic diagram of a specific structure of each module in FIG. 2.

One embodiment of the present disclosure provides an OLED pixel circuit. As shown in FIG. 3, the driving module 10 includes a first transistor T1, a first capacitor C1 and a second transistor T2.

A gate electrode of the first transistor T1 is connected to the scan signal input terminal GATE, a first electrode of the first transistor T1 is connected to the data signal input terminal DATA, and a second electrode of the first transistor T1 is connected to a gate electrode of the second transistor T2.

A first electrode of the second transistor T2 is connected to the first voltage terminal V1, and a second electrode of the second transistor T2 is connected to the light emitting module 20.

A first terminal of the first capacitor C1 is connected to the second electrode of the first transistor T1, and a second terminal of the first capacitor C1 is connected to the first electrode of the second transistor T2.

Figure 4:
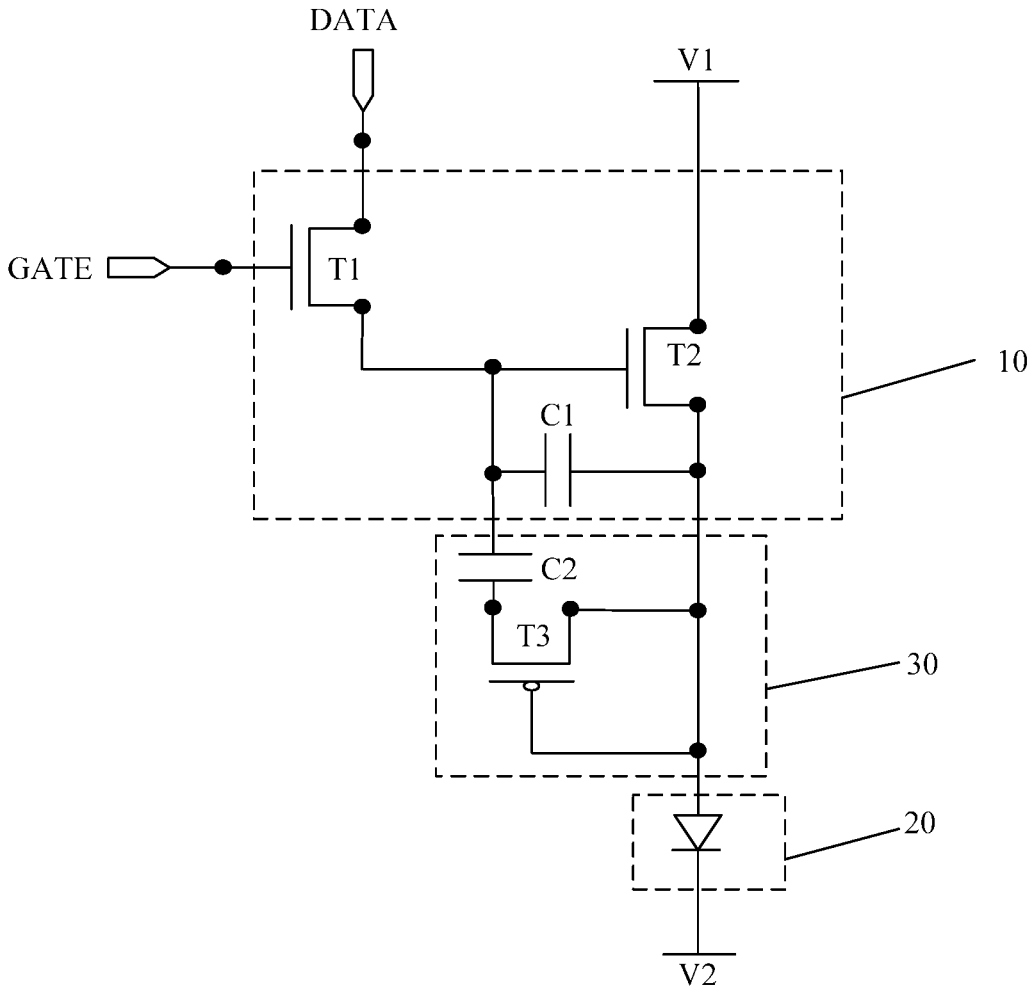
FIG. 4 is a second schematic diagram of a specific structure of each module in FIG. 2.

Alternatively, as shown in FIG. 4, a first terminal of the first capacitor C1 is connected to the second electrode of the first transistor T1, and a second terminal of the first capacitor C1 is connected to a second electrode of the second transistor T2.

The light emitting module 20 includes an OLED, an anode of the OLED is connected to the driving module 10, and a cathode of the OLED is connected to the second voltage terminal V2.

The short-circuit protection module 30 includes a third transistor T3 and a second capacitor C2. Each of a gate electrode of the third transistor T3 and a first electrode of the third transistor T3 is connected to both the light emitting module 20 and the driving module 10, and a second electrode of the third transistor T3 is connected to a first terminal of the second capacitor C2.

A second terminal of the second capacitor is connected to the driving module 10.

In the embodiment, the second transistor T2 is an N-type transistor; and the third transistor T3 is a P-type transistor.

In further detail, a first electrode of the second transistor T2 is connected to the first voltage terminal V1, and a second electrode of the second transistor T2 is connected to an anode of the OLED.

As shown in FIG. 3, the first terminal of the first capacitor C1 is connected to both a second electrode of the first transistor T1 and a gate electrode of the second transistor T2, and the second terminal of the first capacitor C1 is connected to both a first electrode of the second transistor T2 and the first voltage terminal V1.

Alternatively, as shown in FIG. 4, the first terminal of the first capacitor C1 is connected to both a second electrode of the first transistor T1 and a gate electrode of the second transistor T2, and the second terminal of the first capacitor C1 is connected to both a second electrode of the second transistor T2 and the anode of the OLED.

The gate electrode of the third transistor T3 is connected to both a second electrode of the second transistor T2 and an anode of the OLED; the first electrode of the third transistor T3 is connected to both a second electrode of the second transistor T2 and an anode of the OLED; the second electrode of the third transistor T3 is connected to the first terminal of the second capacitor C2.

The second terminal of the second capacitor C2 is connected to both a second electrode of the first transistor T1 and a gate electrode of the second transistor T2.

It should be noted that, firstly, the first transistor T1 may be an N-type transistors or a P-type transistor. In the embodiment of the present disclosure, preferably, the first transistor T1 is an N-type transistor. In FIG. 3 and FIG. 4, for example, the first transistor T1 is an N-type transistor.

Secondly, the transistor provided by the embodiment of the present disclosure may be an enhancement type transistor or a depletion type transistor. The first electrode of the transistor provided by the embodiment of the present disclosure may be a source electrode, the second electrode may be a drain electrode, or the first electrode of the transistor may be a drain electrode and the second electrode may be a source electrode, which is not limited in the present disclosure and may be properly selected according to the type of the transistor.

Thirdly, in the implementation of the present disclosure, for example, the first voltage terminal V1 constantly outputs a high level and the second voltage terminal V2 constantly outputs a low level.

Fourthly, after the third transistor T3 is turned on, the second voltage terminal V2 pulls down the high voltage signal input to the second capacitor C2 from the data signal input terminal DATA through the third transistor T3, to prevent the high voltage signal input from the data signal input terminal DATA from being output to the anode of the OLED.

In the above, as shown in FIG. 3 and FIG. 4, when the scan signal input terminal GATE inputs a scan signal, the first transistor T1 is turned on. A data signal is input from the data signal input terminal DATA, output to the gate electrode of the second transistor T2 through the first transistor T1, and meanwhile charges the first capacitor C1. The second transistor T2 is a P-type transistor. Under control of the high voltage signal, the second transistor T2 is turned on. The high voltage signal of the first voltage terminal V1 is output to the anode of the OLED through the second transistor T2, while the low voltage signal of the second voltage terminal V2 is output to the cathode of the OLED, to drive the OLED to emit light. In the embodiment, the third transistor T3 is an N-type transistor which is turned on when the gate electrode receives a low voltage signal. During normal display, the anode of the OLED outputs a high voltage signal to the gate electrode of the third transistor T3, and the third transistor T3 is turned off.

When a short circuit occurs between the anode and the cathode of the OLED, a potential on the anode is reduced. At this time, the anode outputs a low voltage signal to the gate electrode of the third transistor T3, to control the third transistor T3 to be turned on. The low voltage signal on the anode is output to the gate electrode of the second transistor T2 via the third transistor T3. Under the control of the low voltage signal, the second transistor T2 is turned off. The high voltage signal of the first voltage terminal V1 stops to be output to the anode, and the second voltage terminal V2 pulls down the high voltage signal input to the second capacitor C2 from the data signal input terminal DATA through the third transistor T3, such that the high voltage signal of the data signal input terminal DATA cannot be output to the anode either.

Based on this, after a short circuit occurs between the anode and the cathode of the OLED, the low potential on the cathode will not rise due to neutralization with the high potential on the anode and therefore does not affect the signal on the second voltage terminal V2.

Figure 5:
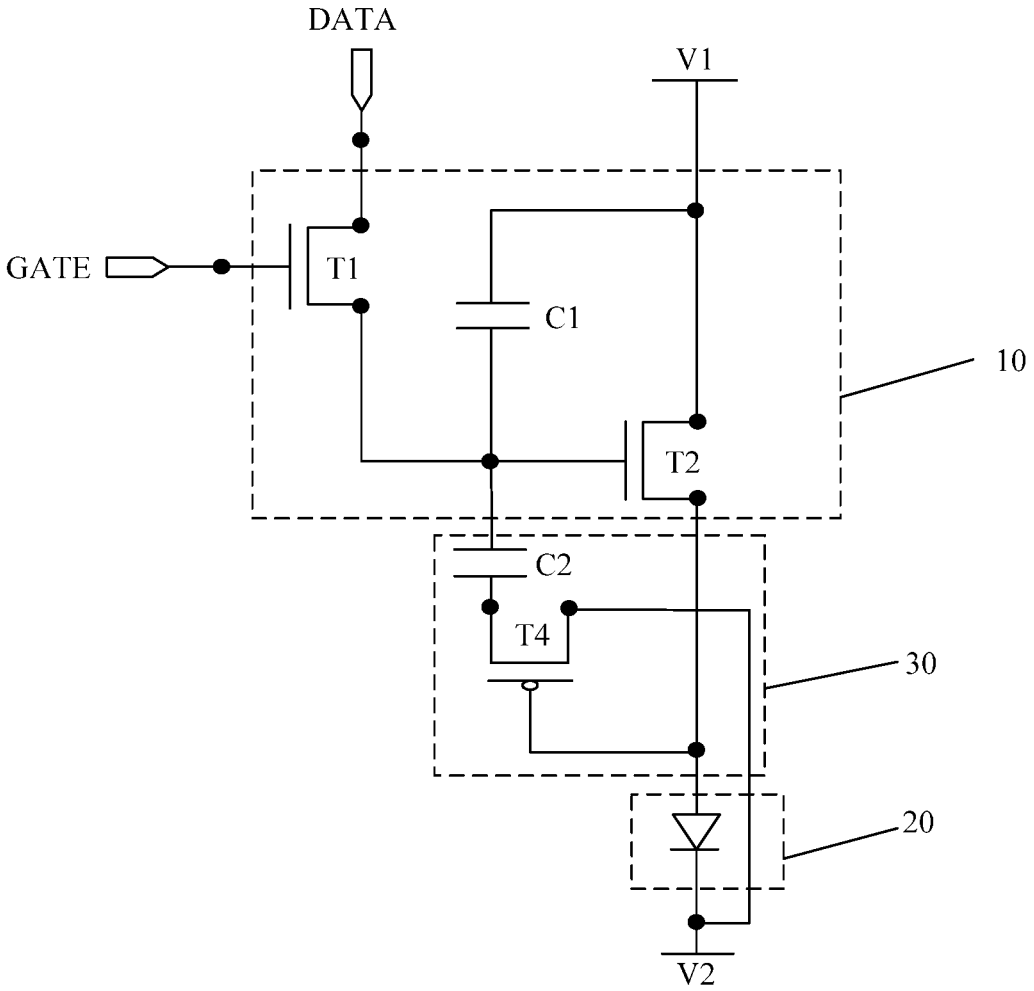
FIG. 5 is a third schematic diagram of a specific structure of each module in FIG. 2.

Another embodiment of the present disclosure provides an OLED pixel circuit. As shown in FIG. 5, the driving module 10 includes a first transistor T1, a first capacitor C1 and a second transistor T2.

A gate electrode of the first transistor T1 is connected to the scan signal input terminal GATE, a first electrode of the first transistor T1 is connected to the data signal input terminal DATA, and a second electrode of the first transistor T1 is connected to a gate electrode of the second transistor T2.

A first electrode of the second transistor T2 is connected to the first voltage terminal V1, and a second electrode of the second transistor T2 is connected to the light emitting module 20.

A first terminal of the first capacitor C1 is connected to the second electrode of the first transistor T1, and a second terminal of the first capacitor C1 is connected to the first electrode of the second transistor T2.

Figure 6:
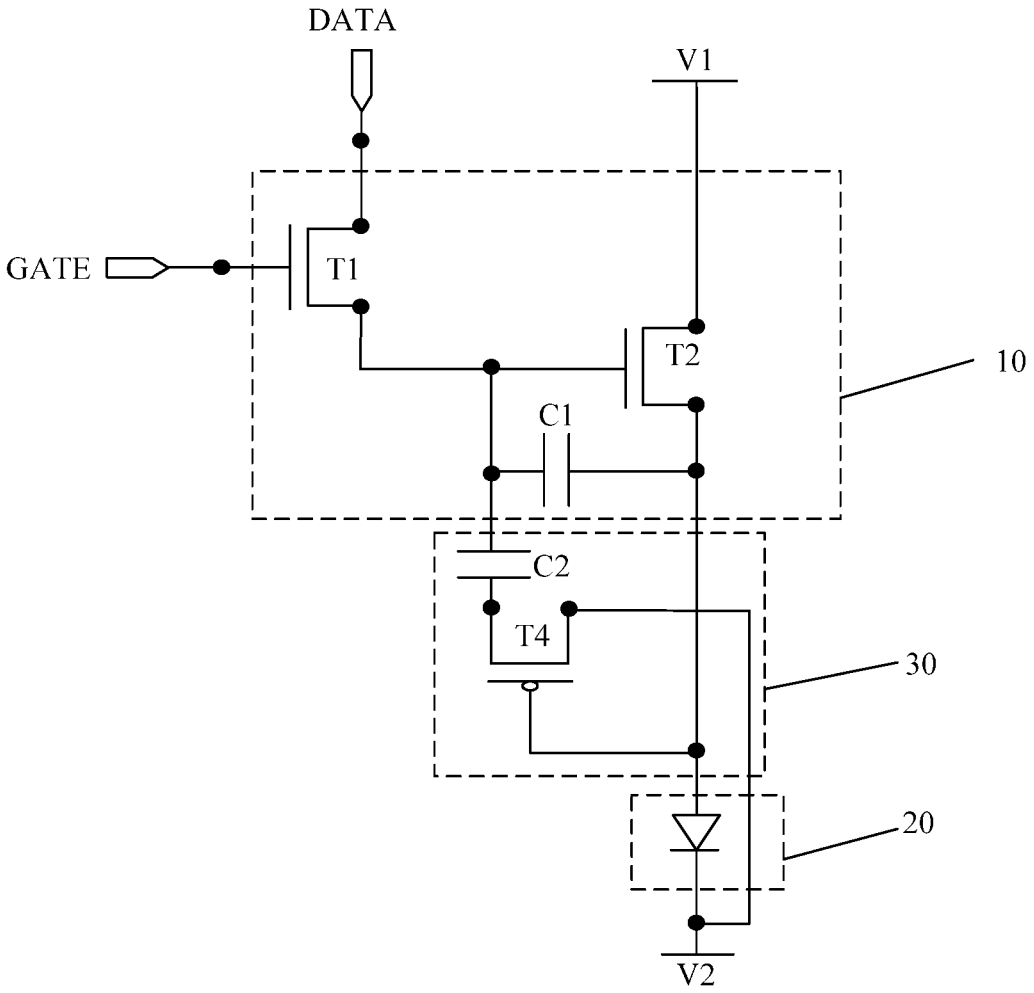
FIG. 6 is a fourth schematic diagram of a specific structure of each module in FIG. 2.

Alternatively, as shown in FIG. 6, a first terminal of the first capacitor C1 is connected to the second electrode of the first transistor T1, and a second terminal of the first capacitor C1 is connected to a second electrode of the second transistor T2.

The light emitting module 20 includes an OLED, an anode of the OLED is connected to the driving module 10, and a cathode of the OLED is connected to the second voltage terminal V2.

The short-circuit protection module 30 includes a fourth transistor T4 and a second capacitor; a gate electrode of the fourth transistor T4 is connected to both the light emitting module 20 and the driving module 10, a first electrode of the fourth transistor T4 is connected to both the light emitting module 20 and the second voltage terminal V2, a second electrode of the fourth transistor T4 is connected to a first terminal of the second capacitor C2.

A second terminal of the second capacitor C2 is connected to the driving module 20.

In the embodiment, the second transistor is an N-type transistor; and the fourth transistor is a P-type transistor.

In further detail, a first electrode of the second transistor T2 is connected to the first voltage terminal V1, and a second electrode of the second transistor T2 is connected to an anode of the OLED.

As shown in FIG. 5, the first terminal of the first capacitor C1 is connected to both a second electrode of the first transistor T1 and a gate electrode of the second transistor T2, and the second terminal of the first capacitor C1 is connected to both a first electrode of the second transistor T2 and the first voltage terminal V1.

Alternatively, as shown in FIG. 6, the first terminal of the first capacitor C1 is connected to both a second electrode of the first transistor T1 and a gate electrode of the second transistor T2, and the second terminal of the first capacitor C1 is connected to both a second electrode of the second transistor T2 and the anode of the OLED.

The gate electrode of the fourth transistor T4 is connected to both a second electrode of the second transistor T2 and an anode of the OLED, a first electrode of the fourth transistor T4 is connected to both the second voltage terminal V2 and a cathode of the OLED, and a second electrode of the fourth transistor T4 is connected to the first terminal of the second capacitor C2.

The second terminal of the second capacitor C2 is connected to both the second electrode of the first transistor T1 and a gate electrode of the second transistor T2.

In the above, as shown in FIG. 5 and FIG. 6, when the scan signal input terminal GATE inputs a scan signal, the first transistor T1 is turned on. A data signal is input from the data signal input terminal DATA, output to the gate electrode of the second transistor T2 through the first transistor T1, and meanwhile charges the first capacitor C1. The second transistor T2 is a P-type transistor. Under control of the high voltage signal, the second transistor T2 is turned on. The high voltage signal of the first voltage terminal V1 is output to the anode of the OLED through the second transistor T2, while the low voltage signal of the second voltage terminal V2 is output to the cathode of the OLED, to drive the OLED to emit light. In the embodiment, the fourth transistor T4 is an N-type transistor which is turned on when the gate electrode receives a low voltage signal. During normal display, the anode of the OLED outputs a high voltage signal to the gate electrode of the fourth transistor T4, and the fourth transistor T4 is turned off.

When a short circuit occurs between the anode and the cathode of the OLED, a potential on the anode is reduced. At this time, the anode outputs a low voltage signal to the gate electrode of the fourth transistor T4, to control the fourth transistor T4 to be turned on. The low voltage signal on the second voltage terminal V2 is output to the gate electrode of the second transistor T2 via the fourth transistor T4. Under the control of the low voltage signal, the second transistor T2 is turned off. The high voltage signal of the first voltage terminal V1 stops to be output to the anode, and the second voltage terminal V2 pulls down the high voltage signal input to the second capacitor C2 from the data signal input terminal DATA through the third transistor T3, such that the high voltage signal of the data signal input terminal DATA cannot be output to the anode either.

The embodiments of the present disclosure further provide a display device including any one of the above OLED pixel circuits, which has the same structure and beneficial effect as the OLED pixel circuit provided by the previous embodiments. Since the structure and beneficial effects of the OLED pixel circuit have been described in detail in the foregoing embodiments, details will not be repeated herein.

The embodiments of the present disclosure further provide a driving method of the above OLED pixel circuit, including:

the scan signal input terminal GATE inputting a scanning signal, the data signal input terminal DATA inputting a data signal, and the driving module 10 driving the light emitting module to emit light; and in the case where a short circuit occurs in the light emitting module 20, the short-circuit protection module 30 controlling the driving module 10 to be turned off.

Specifically, as shown in FIG. 3 and FIG. 4, the scan signal input terminal GATE inputs the scanning signal to control the first transistor T1 to be turned on, and the data signal input terminal DATA inputs the data signal to control the second transistor T2 to be turned on, to drive the OLED to emit light.

In the case where the OLED emits light normally, a signal output by the first voltage terminal V1 to the anode through the second transistor T2 controls the third transistor T3 to be turned off.

In the case where the OLED is short-circuited, a signal applied to the anode by the second voltage terminal V2 controls the third transistor T3 to be turned on, such that the signal applied to the anode by the second voltage terminal V2 controls the second transistor T2 to be turned off.

Alternatively, as shown in FIG. 5 and FIG. 6, in the case where the OLED emits light normally, a signal output by the first voltage terminal V1 to the anode through the second transistor T2 controls the fourth transistor T4 to be turned off.

In the case where the OLED is short-circuited, a signal applied to the anode by the second voltage terminal V2 controls the fourth transistor T4 to be turned on, such that the signal on the second voltage terminal V2 directly controls the second transistor T2 to be turned off.

The embodiments of the present disclosure provide a driving method of the OLED pixel circuit. A short-circuit protection module 30 is added to the OLED pixel circuit. When a light emitting module 20 of a sub-pixel emits light normally, the short-circuit protection module 30 is turned off, while when the light emitting module 20 of the sub-pixel is short-circuited, the short-circuit protection module 30 is turned on to control to turn off the driving module 10, so that signals of the first voltage terminal V1 and the data single input terminal DATA cannot be output to the light emitting module 20. In this way, even if the light emitting module 20 is short-circuited, a signal at the second voltage terminal V2 connected to the light emitting module 20 will not rise, but still maintains its original signal intensity, so as to prevent a certain sub-pixel where a short circuit occurs from affecting the normal display of the peripheral sub-pixels.

The foregoing descriptions are merely specific embodiments of the present disclosure, but the protection scope of the present disclosure is not limited thereto. Changes or substitutions easily conceived by anyone skilled in the art within the technical scope disclosed in the present disclosure should be covered in the protection scope of the present disclosure. Therefore, the protection scope of the present disclosure should be based on the protection scope of the claims.

What is claimed is:

1. An OLED pixel circuitry, comprising a driving circuit, a light emitting circuit, and a short-circuit protection circuit, wherein the driving circuit is coupled to a scan signal input terminal, a data signal input terminal, a first voltage terminal, and the light emitting circuit respectively, and is configured to drive the light emitting circuit to emit light under control of the scan signal input terminal, the data signal input terminal, and the first voltage terminal;

the light emitting circuit is further coupled to a second voltage terminal, and is configured to emit light under control of the driving circuit and the second voltage terminal, wherein the light emitting circuit comprises an OLED, wherein an anode of the OLED is coupled to the driving circuit, and a cathode of the OLED is coupled to the second voltage terminal; and the short-circuit protection circuit is coupled to the driving circuit and the light emitting circuit, wherein the short-circuit protection circuit comprises a control end connected to the anode of the OLED, and is configured to control the driving circuit to be turned off when a short circuit occurs between the anode and the cathode of the OLED.

2. The OLED pixel circuitry according to claim 1, wherein the driving circuit comprises a first transistor, a first capacitor, and a second transistor;

a gate electrode of the first transistor is coupled to the scan signal input terminal, a first electrode of the first transistor is coupled to the data signal input terminal, and a second electrode of the first transistor is coupled to a gate electrode of the second transistor;

a first electrode of the second transistor is coupled to the first voltage terminal, and a second electrode of the second transistor is coupled to the light emitting circuit;

a first terminal of the first capacitor is coupled to the second electrode of the first transistor, and a second terminal of the first capacitor is coupled to the first electrode of the second transistor; and the second transistor is an N-type transistor.

3. The OLED pixel circuitry according to claim 1, wherein the driving circuit comprises a first transistor, a first capacitor, and a second transistor;

a gate electrode of the first transistor is coupled to the scan signal input terminal, a first electrode of the first transistor is coupled to the data signal input terminal, and a second electrode of the first transistor is coupled to a gate electrode of the second transistor;

a first electrode of the second transistor is coupled to the first voltage terminal, and a second electrode of the second transistor is coupled to the light emitting circuit;

a first terminal of the first capacitor is coupled to the second electrode of the first transistor, and a second terminal of the first capacitor is coupled to a second electrode of the second transistor; and the second transistor is an N-type transistor.

4. The OLED pixel circuitry according to claim 1, wherein the short-circuit protection circuit comprises a first transistor and a first capacitor;

each of a gate electrode of the first transistor and a first electrode of the first transistor is coupled to both the light emitting circuit and the driving circuit, and a second electrode of the first transistor is coupled to a first terminal of the first capacitor;

a second terminal of the first capacitor is coupled to the driving circuit; and the first transistor is a P-type transistor.

5. The OLED pixel circuitry according to claim 4, wherein the driving circuit comprises a second transistor, a second capacitor, and a third transistor, and the light emitting circuit comprises an OLED;

the gate electrode of the first transistor is coupled to both a second electrode of the third transistor and an anode of the OLED, and the first electrode of the first transistor is coupled to both the second electrode of the third transistor and the anode of the OLED; and the second terminal of the first capacitor is coupled to both a second electrode of the second transistor and a gate electrode of the third transistor.

6. The OLED pixel circuitry according to claim 5, wherein a gate electrode of the second transistor is coupled to the scan signal input terminal, a first electrode of the second transistor is coupled to the data signal input terminal, and the second electrode of the second transistor is coupled to the gate electrode of the third transistor;

a first electrode of the third transistor is coupled to the first voltage terminal, and the second electrode of the third transistor is coupled to the light emitting circuit; and a first terminal of the second capacitor is coupled to the second electrode of the second transistor, and a second terminal of the second capacitor is coupled to the first electrode of the third transistor.

7. The OLED pixel circuitry according to claim 5, wherein a gate electrode of the second transistor is coupled to the scan signal input terminal, a first electrode of the second transistor is coupled to the data signal input terminal, and the second electrode of the second transistor is coupled to the gate electrode of the third transistor;

a first electrode of the third transistor is coupled to the first voltage terminal, and the second electrode of the third transistor is coupled to the light emitting circuit; and a first terminal of the second capacitor is coupled to the second electrode of the second transistor, and a second terminal of the second capacitor is coupled to the second electrode of the third transistor.

8. The OLED pixel circuitry according to claim 1, wherein the short-circuit protection circuit comprises a first transistor and a first capacitor;

a gate electrode of the first transistor is coupled to both the light emitting circuit and the driving circuit, a first electrode of the first transistor is coupled to both the light emitting circuit and the second voltage terminal, a second electrode of the first transistor is coupled to a first terminal of the first capacitor;

a second terminal of the first capacitor is coupled to the driving circuit; and the first transistor is a P-type transistor.

9. The OLED pixel circuitry according to claim 8, wherein the driving circuit comprises a second transistor, a second capacitor, and a third transistor, and the light emitting circuit comprises an OLED;

the gate electrode of the first transistor is coupled to both a second electrode of the third transistor and an anode of the OLED, and a first electrode of the first transistor is coupled to both a cathode of the OLED and the second voltage terminal; and the second terminal of the first capacitor is coupled to both the second electrode of the second transistor and a gate electrode of the third transistor.

10. The OLED pixel circuitry according to claim 9, wherein a gate electrode of the second transistor is coupled to the scan signal input terminal, a first electrode of the second transistor is coupled to the data signal input terminal, and the second electrode of the second transistor is coupled to the gate electrode of the third transistor;

a first electrode of the third transistor is coupled to the first voltage terminal, and the second electrode of the third transistor is coupled to the light emitting circuit; and a first terminal of the second capacitor is coupled to the second electrode of the second transistor, and a second terminal of the second capacitor is coupled to the first electrode of the third transistor.

11. The OLED pixel circuitry according to claim 9, wherein a gate electrode of the second transistor is coupled to the scan signal input terminal, a first electrode of the second transistor is coupled to the data signal input terminal, and the second electrode of the second transistor is coupled to the gate electrode of the third transistor;

a first electrode of the third transistor is coupled to the first voltage terminal, and the second electrode of the third transistor is coupled to the light emitting circuit; and a first terminal of the second capacitor is coupled to the second electrode of the second transistor, and a second terminal of the second capacitor is coupled to the second electrode of the third transistor.

12. The OLED pixel circuitry according to claim 2, wherein the second transistor is an N-type transistor.

13. A display device, comprising the OLED pixel circuitry according to claim 1.

14. A driving method of the OLED pixel circuitry according to claim 1, comprising:

the scan signal input terminal inputting a scanning signal, the data signal input terminal inputting a data signal, the driving circuit driving the light emitting circuit to emit light; and in the case where a short circuit occurs in the light emitting circuit, the short-circuit protection circuit controlling the driving circuit to be turned off.

15. The driving method according to claim 14, wherein the driving circuit comprises a first transistor, a first capacitor and a second transistor;

a gate electrode of the first transistor is coupled to the scan signal input terminal, a first electrode of the first transistor is coupled to the data signal input terminal, and a second electrode of the first transistor is coupled to a gate electrode of the second transistor;

a first electrode of the second transistor is coupled to the first voltage terminal, and a second electrode of the second transistor is coupled to the light emitting circuit;

a first terminal of the first capacitor is coupled to the second electrode of the first transistor, and a second terminal of the first capacitor is coupled to the first electrode of the second transistor; and the second transistor is an N-type transistor, wherein the short-circuit protection circuit comprises a third transistor and a second capacitor;

each of a gate electrode of the third transistor and a first electrode of the third transistor is coupled to both the light emitting circuit and the driving circuit, and a second electrode of the third transistor is coupled to a first terminal of the second capacitor;

a second terminal of the second capacitor is coupled to the driving circuit; and the third transistor is a P-type transistor, and wherein the driving method comprises:

the scan signal input terminal inputting the scanning signal to control the first transistor to be turned on, and the data signal input terminal inputting the data signal to control the second transistor to be turned on, to drive the OLED to emit light;

in the case where the OLED emits light normally, a signal output by the second transistor to the anode controlling the third transistor to be turned off; and in the case where the OLED is short-circuited, a signal applied to the anode by the second voltage terminal controlling the third transistor to be turned on, such that the second transistor is turned off.

16. The driving method according to claim 14, wherein the driving circuit comprises a first transistor, a first capacitor and a second transistor;

a gate electrode of the first transistor is coupled to the scan signal input terminal, a first electrode of the first transistor is coupled to the data signal input terminal, and a second electrode of the first transistor is coupled to a gate electrode of the second transistor;

a first electrode of the second transistor is coupled to the first voltage terminal, and a second electrode of the second transistor is coupled to the light emitting circuit;

a first terminal of the first capacitor is coupled to the second electrode of the first transistor, and a second terminal of the first capacitor is coupled to the first electrode of the second transistor; and the second transistor is an N-type transistor, wherein the short-circuit protection circuit comprises a third transistor and a second capacitor;

a gate electrode of the third transistor is coupled to both the light emitting circuit and the driving circuit, a first electrode of the third transistor is coupled to both the light emitting circuit and the second voltage terminal, a second electrode of the third transistor is coupled to a first terminal of the second capacitor;

a second terminal of the second capacitor is coupled to the driving circuit; and the third transistor is a P-type transistor, and wherein the driving method comprises:

the scan signal input terminal inputting the scanning signal to control the first transistor to be turned on, and the data signal input terminal inputting the data signal to control the second transistor to be turned on, to drive the OLED to emit light;

in the case where the OLED emits light normally, a signal output by the second transistor to the anode controlling the third transistor to be turned off; and in the case where the OLED is short-circuited, a signal applied to the anode by second voltage terminal controlling the third transistor to be turned on, such that the second transistor is turned off.

17. The driving method according to claim 14, wherein the driving circuit comprises a first transistor, a first capacitor and a second transistor;

a gate electrode of the first transistor is coupled to the scan signal input terminal, a first electrode of the first transistor is coupled to the data signal input terminal, and a second electrode of the first transistor is coupled to a gate electrode of the second transistor;

a first electrode of the second transistor is coupled to the first voltage terminal, and a second electrode of the second transistor is coupled to the light emitting circuit;

a first terminal of the first capacitor is coupled to the second electrode of the first transistor, and a second terminal of the first capacitor is coupled to a second electrode of the second transistor; and the second transistor is an N-type transistor, wherein the short-circuit protection circuit comprises a third transistor and a second capacitor;

each of a gate electrode of the third transistor and a first electrode of the third transistor is coupled to both the light emitting circuit and the driving circuit, and a second electrode of the third transistor is coupled to a first terminal of the second capacitor;

a second terminal of the second capacitor is coupled to the driving circuit; and the third transistor is a P-type transistor, and wherein the driving method comprises:

the scan signal input terminal inputting the scanning signal to control the first transistor to be turned on, and the data signal input terminal inputting the data signal to control the second transistor to be turned on, to drive the OLED to emit light;

in the case where the OLED emits light normally, a signal output by the second transistor to the anode controlling the third transistor to be turned off; and in the case where the OLED is short-circuited, a signal applied to the anode by the second voltage terminal controlling the third transistor to be turned on, such that the second transistor is turned off.

18. The driving method according to claim 14, wherein the driving circuit comprises a first transistor, a first capacitor and a second transistor;

a gate electrode of the first transistor is coupled to the scan signal input terminal, a first electrode of the first transistor is coupled to the data signal input terminal, and a second electrode of the first transistor is coupled to a gate electrode of the second transistor;

a first electrode of the second transistor is coupled to the first voltage terminal, and a second electrode of the second transistor is coupled to the light emitting circuit;

a first terminal of the first capacitor is coupled to the second electrode of the first transistor, and a second terminal of the first capacitor is coupled to the second electrode of the second transistor; and the second transistor is an N-type transistor, wherein the short-circuit protection circuit comprises a third transistor and a second capacitor;

a gate electrode of the third transistor is coupled to both the light emitting circuit and the driving circuit, a first electrode of the third transistor is coupled to both the light emitting circuit and the second voltage terminal, a second electrode of the third transistor is coupled to a first terminal of the second capacitor;

a second terminal of the second capacitor is coupled to the driving circuit; and the third transistor is a P-type transistor, and wherein the driving method comprises:

the scan signal input terminal inputting the scanning signal to control the first transistor to be turned on, and the data signal input terminal inputting the data signal to control the second transistor to be turned on, to drive the OLED to emit light;

in the case where the OLED emits light normally, a signal output by the second transistor to the anode controlling the third transistor to be turned off; and in the case where the OLED is short-circuited, a signal applied to the anode by second voltage terminal controlling the third transistor to be turned on, such that the second transistor is turned off.

* * * * *